US009901979B2

(12) United States Patent
Yang et al.

(10) Patent No.: US 9,901,979 B2
(45) Date of Patent: Feb. 27, 2018

(54) METALLIC ARTICLE AND METHOD FOR MANUFACTURING METALLIC ARTICLE

(71) Applicants: HONG FU JIN PRECISION INDUSTRY (ShenZhen) CO., LTD., Shenzhen (CN); HON HAI PRECISION INDUSTRY CO., LTD., New Taipei (TW)

(72) Inventors: Jun-Jun Yang, Shenzhen (CN); Cai-Hua Wang, Shenzhen (CN); Yue-Jian Li, Shenzhen (CN); Chen-Shen Lin, New Taipei (TW); Wen-Hsiung Chang, New Taipei (TW); Chun-Jung Chang, New Taipei (TW)

(73) Assignees: HONG FU JIN PRECISION INDUSTRY (ShenZhen) CO., LTD., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 281 days.

(21) Appl. No.: 14/692,475

(22) Filed: Apr. 21, 2015

(65) Prior Publication Data

US 2015/0306661 A1 Oct. 29, 2015

(30) Foreign Application Priority Data

Apr. 25, 2014 (CN) ..... 2014 1 0169091

(51) Int. Cl.

| | |
|---|---|
| ***B22D 19/00*** | (2006.01) |
| ***B22D 17/24*** | (2006.01) |
| ***B22C 9/10*** | (2006.01) |
| ***B22D 27/04*** | (2006.01) |

(52) U.S. Cl.

CPC ..... *B22D 19/00* (2013.01); *B22C 9/108* (2013.01); *B22D 17/24* (2013.01); *B22D 19/0072* (2013.01); *B22D 27/04* (2013.01)

(58) Field of Classification Search

CPC .... B22D 17/24; B22D 19/00; B22D 19/0072; B22D 19/0081; B22D 19/16; B22C 9/108

USPC ..... 164/107

See application file for complete search history.

(56) References Cited

U.S. PATENT DOCUMENTS

| | | | | |
|---|---|---|---|---|
| 3,439,732 A * | 4/1969 | Andreoli | ..... | B22D 17/24 164/112 |
| 4,865,112 A * | 9/1989 | Schwarb | ..... | B22D 19/00 164/108 |
| 2012/0152482 A1* | 6/2012 | Osanai | ..... | B22D 19/0072 164/112 |

FOREIGN PATENT DOCUMENTS

| | | | | |
|---|---|---|---|---|
| JP | 59076655 A * | 5/1984 | ..... | B22D 19/0072 |

* cited by examiner

*Primary Examiner* — Kevin E Yoon
*Assistant Examiner* — Jacky Yuen
(74) *Attorney, Agent, or Firm* — ScienBiziP, P.C.

(57) ABSTRACT

A metallic article can include a cast metallic body and at least one metallic element. The cast metallic body defines at least one first space. The least one metallic element is received in the cast metallic body and seamless with the cast metallic body. The at least one metallic element is exposed from the at least one first space. A heat conductivity of the cast metallic body is lower than that of the at least one metallic element. The present disclosure further provides a method for manufacturing metallic article.

13 Claims, 13 Drawing Sheets

METALLIC ARTICLE AND METHOD FOR MANUFACTURING METALLIC ARTICLE

FIELD

The subject matter herein generally relates to metallic articles, and particularly to a metallic article capable of dissipating heat quickly and a method for manufacturing the metallic article.

BACKGROUND

Metallic articles are used in many products, such as an electronic device. When the electronic device is in use, heat may be produced. In order to ensure the performance of the electronic device, the heat in the electronic device needs to be dissipated quickly.

BRIEF DESCRIPTION OF THE DRAWINGS

Implementations of the present technology will now be described, by way of example only, with reference to the attached figures.

DETAILED DESCRIPTION

Figure 1:
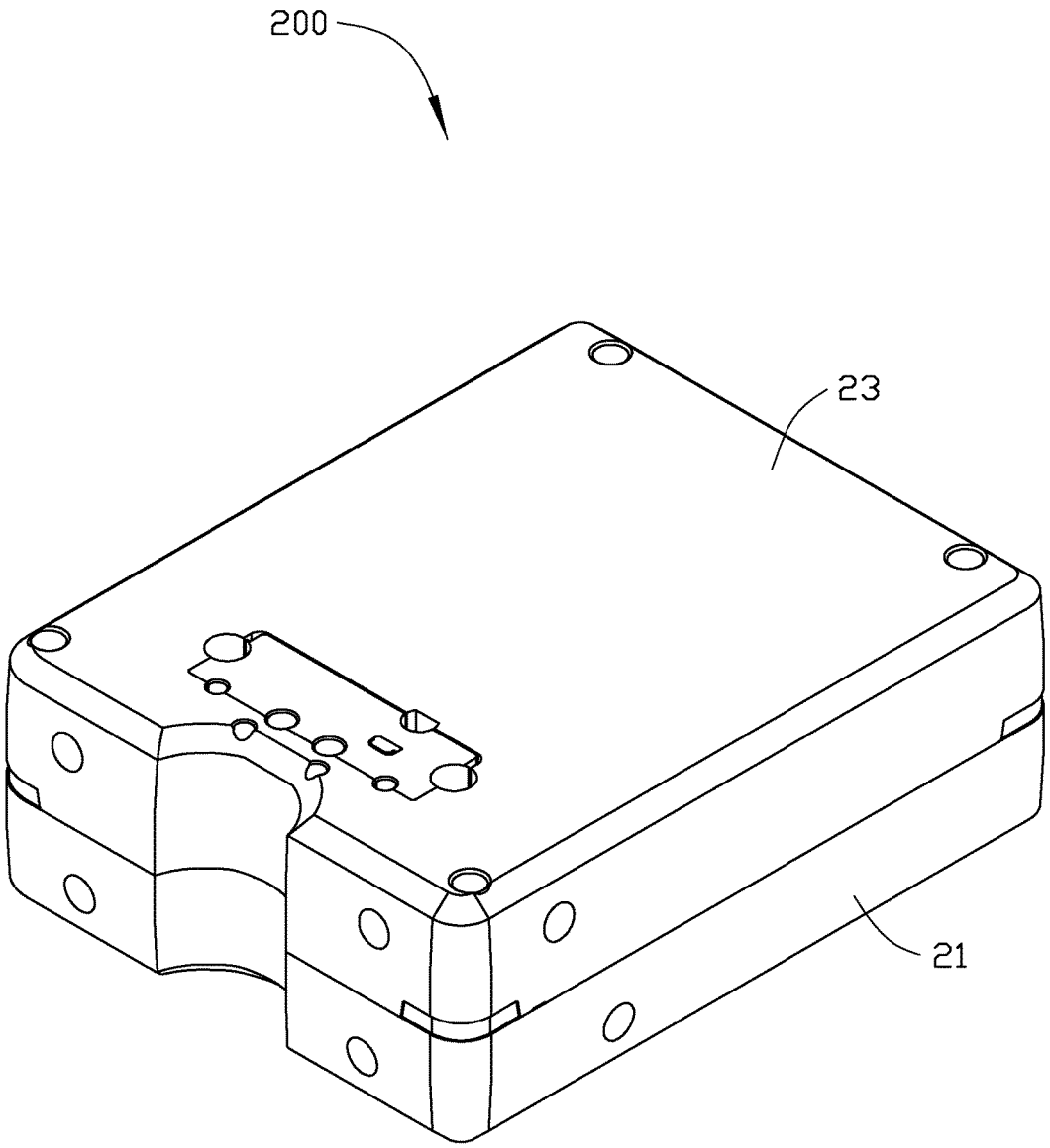
FIG. 1 is an isometric view of an embodiment of a mould, the mould including a first mold, a second mold, and a mold core.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

The present disclosure is in relation to a metallic article can include one or more metallic elements made of a first material and a cast metallic body made of a second material. Each of the one or more metallic elements can have a first end and a second end. The cast metallic body can surround the one or more metallic elements. The cast metallic body can include a defined first space communicating with the first end and a defined second space communicating with the second end of each of the one or more metallic elements. The second material can have a heat conductivity lower than the first material.

Figure 2:
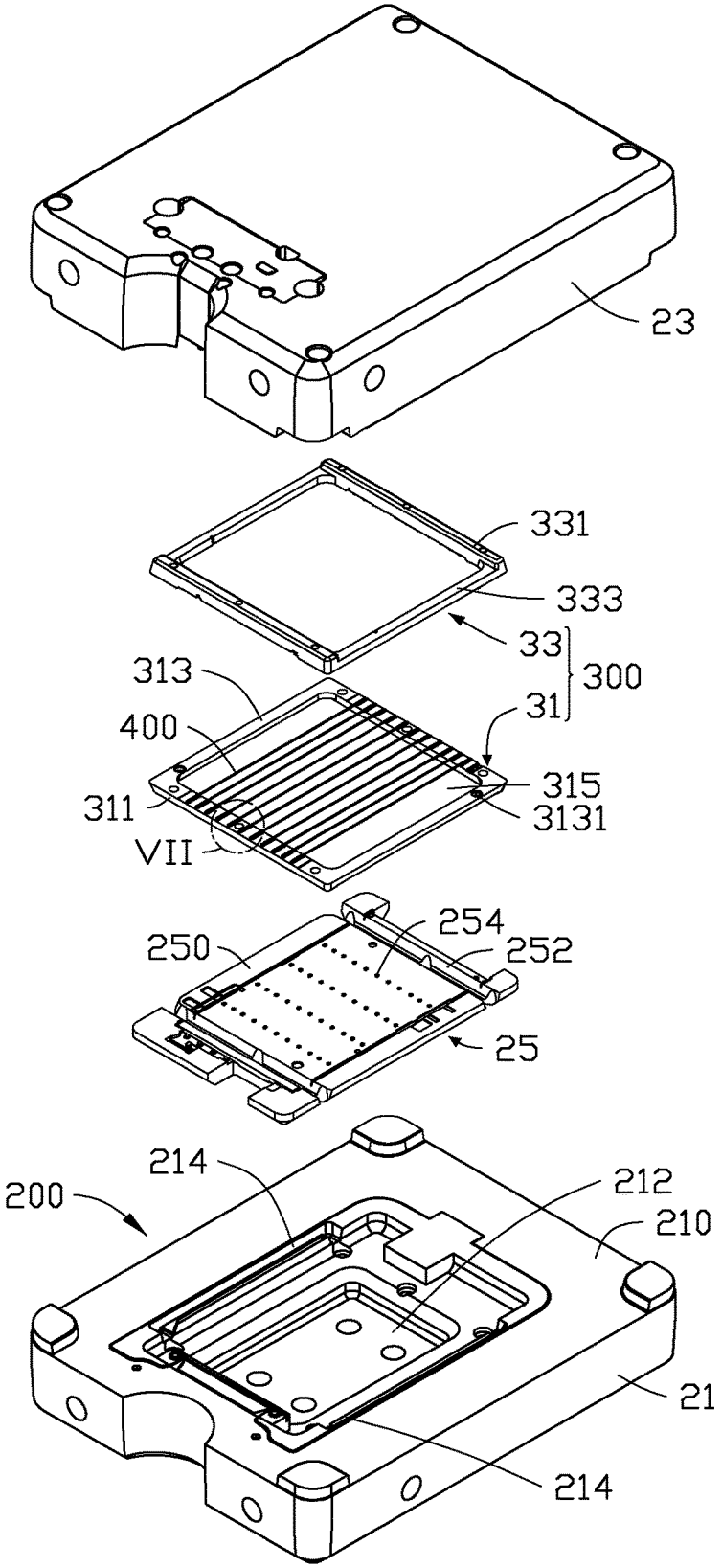
FIG. 2 is an exploded, isometric view of a position tool and the mould of FIG. 1, the position tool including a first position member and a second position member.

FIG. 1 illustrates an assembled isometric view of an embodiment of a mould 200. FIG. 2 illustrates an exploded isometric view of the mould 200 and a position tool 300. The mould 200 and the position tool 300 can be configured to manufacture a metallic article by die-cast molding.

FIG. 2 illustrates that the mould 200 can include a first mold 21, a second mold 23, and a mold core 25. The second mold 23 can be configured to engage with the first mold 21. The mold core 25 can be configured to be positioned between the first mold 21 and the second mold 23. When the mould 200 is closed, the second mold 23 and the mold core 25 can define a die cavity 26 (shown in FIG. 6), cooperatively.

The first mold 21 can be substantially cuboid and can include a mounting surface 210. The mounting surface 210 can be configured to couple the mold core 25 and attach to the second mold 23. The mounting surface 210 can define a first receiving groove 212 and two second receiving grooves 214 communicating with the first receiving groove 212. The second receiving grooves 214 can be positioned at opposite sides of the first receiving groove 212, respectively. The first receiving groove 212 can be positioned between the second receiving grooves 214. The second receiving grooves 214 can be substantially strip-shaped and can be parallel to each other. The first receiving groove 212 can be substantially step-shaped and configured to receive the mold core 25. The second receiving grooves 214 can be configured to receive the position tool 300.

Figure 3:
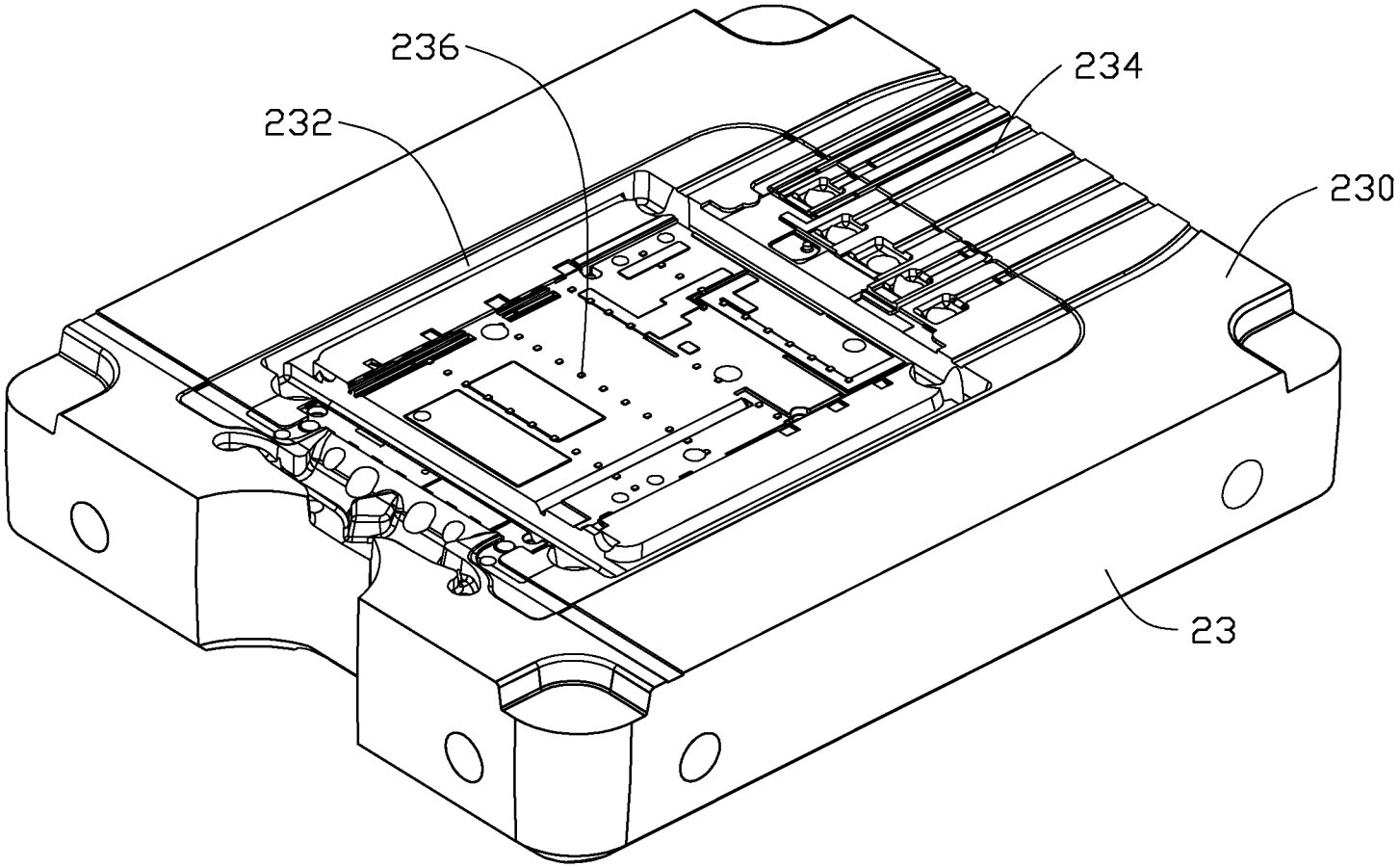
FIG. 3 is an enlarged, isometric view of the second mold of the mould of FIG. 2.

FIG. 3 illustrates that the second mold 23 can be substantially cuboid and can include a pressing surface 230. The pressing surface 230 can define a containing groove 232. The containing groove 232 can be substantially circular and configured to receive the position tool 300. In at least one embodiment, the containing groove 232 can enclose a substantially rectangular area. The pressing surface 230 can further define a plurality of runners 234. The runners 234 can be positioned at an end of the pressing surface 230. The runners 234 can be channels for molten materials flowing into the mould 200 when in use. A plurality of first position protrusions 236 can protrude from the pressing surface 230. The first position protrusions 236 can be positioned in the substantially rectangular area enclosed by the substantially circular containing groove 232 and can be received in the die cavity 26. In the illustrated embodiment, the first position protrusions 236 can be arranged in a matrix with four rows and eleven columns.

Figure 4:
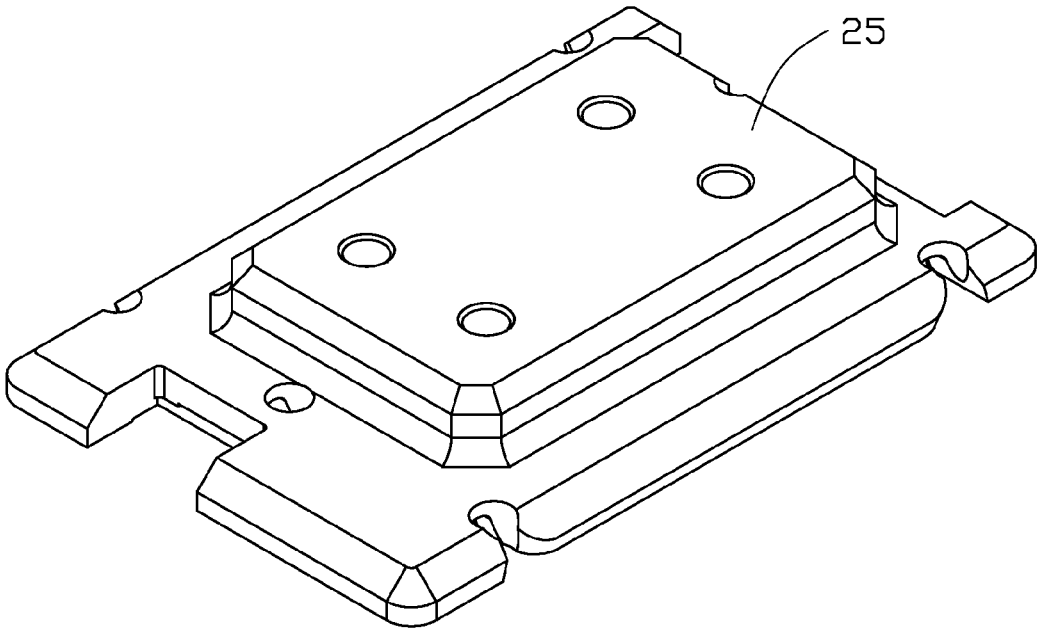
FIG. 4 is an enlarged, isometric view of the mold core of the mould of FIG. 2.
Figure 5:
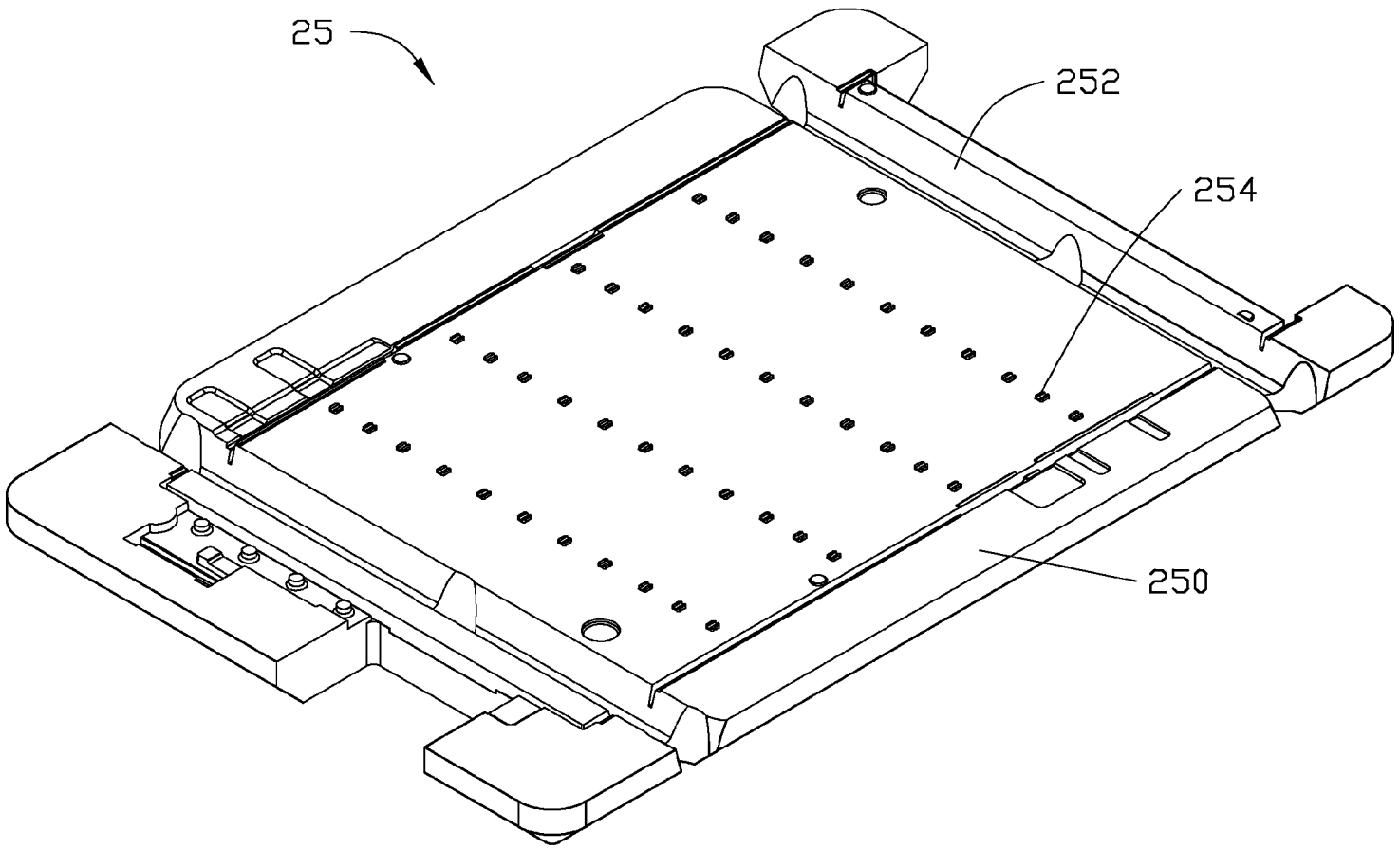
FIG. 5 is similar to FIG. 4, but viewed from another angle.
Figure 6:
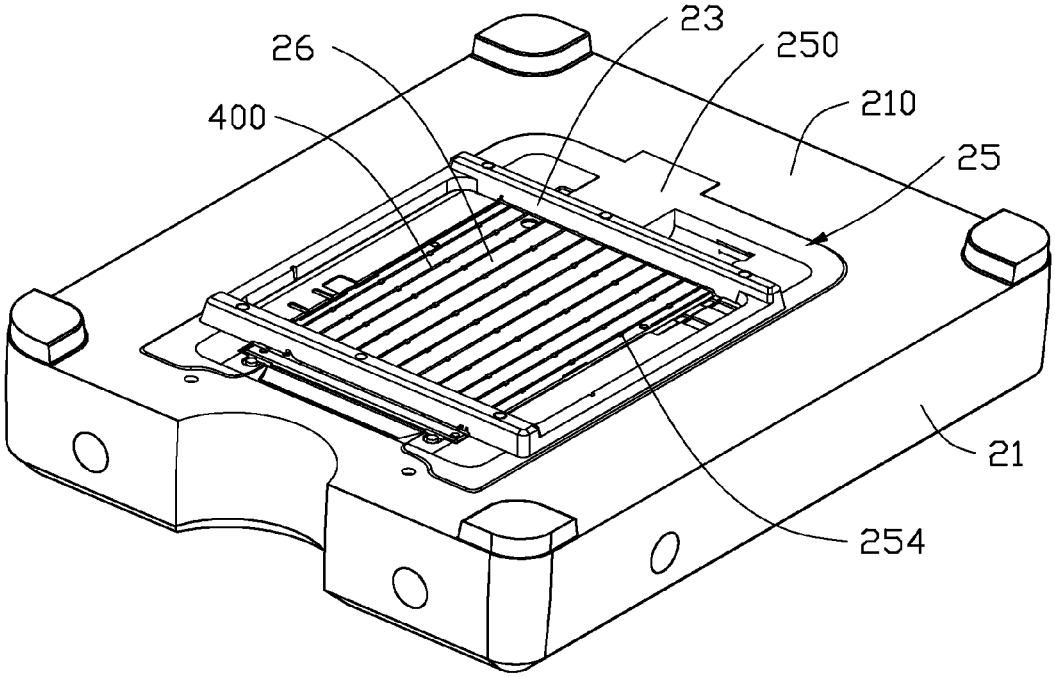
FIG. 6 is an enlarged, isometric view of the first mold and the position tool of FIG. 2.

FIGS. 4 and 5 illustrate enlarged, isometric views of the mold core 25 at different angles. FIG. 4 illustrates that the mold core 25 can be in a shape correspond to a shape of the first receiving groove 212 of the first mold 21. The mold core 25 can have a stepped bottom corresponding to the first receiving groove 212. FIG. 5 illustrates that the mold core 25 can include a top surface 250. The mold core 25 can be received in the first receiving groove 212, and the top surface 250 can be coplanar with the mounting surface 210. The top surface 250 can define two third receiving grooves 252 parallel to each other. The third receiving grooves 252 can be positioned at opposite ends of the top surface 250, respectively. Opposite ends of each third receiving groove 252 can run through opposite sidewalls of the mold core 25. A plurality of second position protrusions 254 can protrude from the top surface 250. The second position protrusions 254 can be positioned between the two third receiving grooves 252. When the first mold 21 is coupled to the second mold 23, each second position protrusion 254 can be aligned with one of the first position protrusions 236 in a direction perpendicular to the top surface 250. In the illustrated embodiment, the second position protrusions 254 can be arranged in a matrix with four rows and eleven columns. FIG. 6 illustrates that the second position protrusions 254 can be received in the die cavity 26.

Referring to FIG. 2 again, the position tool 300 can include a first position member 31 and a second position member 33 detachably coupled to the first position member 31. The first position member 31 can be a substantially rectangular frame, and can include two first fixing portions 311 opposite to each other and two second fixing portions 313 opposite to each other. Each of the first fixing portions 311 can be coupled to the two second fixing portions 313, such that the first fixing portions 311 and the second fixing portions 313 can cooperatively form a substantially rectangular frame having a receiving room 315. In the illustrated embodiment, the first fixing portions 311 can be substantially parallel to each other, and the second fixing portions 313 can be substantially parallel to each other. The first fixing portions 311 can be substantially perpendicular to the second fixing portions 313.

The second position member 33 can have a structure substantially similar to a structure of the first position member 31. The second position member 33 can also include two first fixing portions 331 parallel to each other and two second fixing portions 333 parallel to each other.

Figure 7:
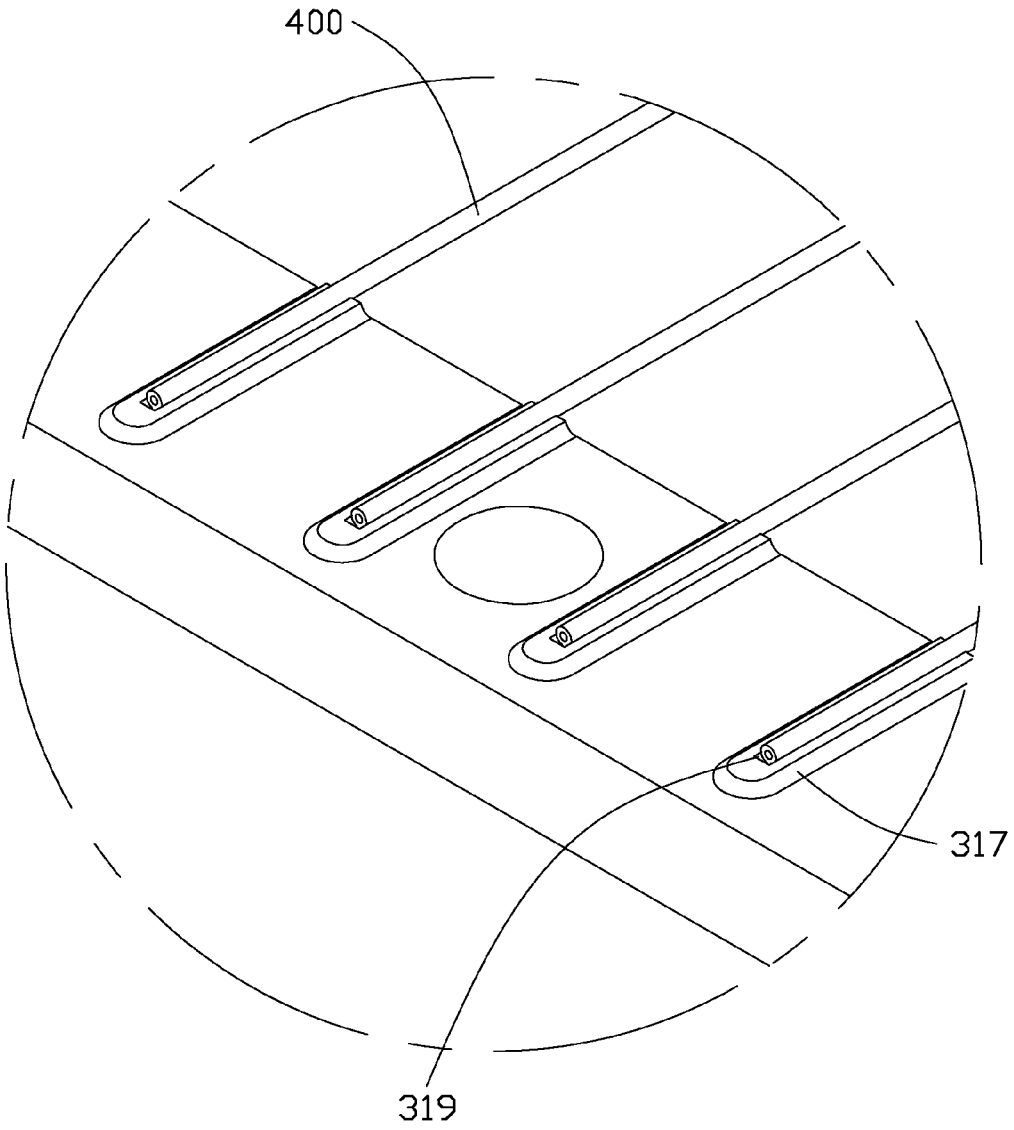
FIG. 7 is an enlarged view of a circle portion VII of FIG. 2.

FIG. 7 illustrates that a plurality of first latching protrusions 317 can protrude from each first fixing portion 311. The first latching protrusions 317 can be arranged apart, and substantially parallel to each other. In the illustrated embodiment, each first latching protrusion 317 can be substantially strip shaped. Eleven first latching protrusions 317 can be formed on each first fixing portion 311, and arranged in a row parallel to a longitudinal direction of the first fixing portion 311. A longitudinal direction of each first latching protrusion 317 can be substantially perpendicular to the longitudinal direction of the first fixing portion 311. Each first latching protrusion 317 can define a latching groove 319 at a top thereof. A longitudinal direction of the latching groove 319 can be substantially perpendicular to the longitudinal direction of the first fixing portion 311. A positioning hole 3131 can be defined on each second fixing portion 313. The two positioning hole 3131 can be positioned at two diagonal corners of the first position member 31, and configured for positioning the second position member 33.

Figure 8:
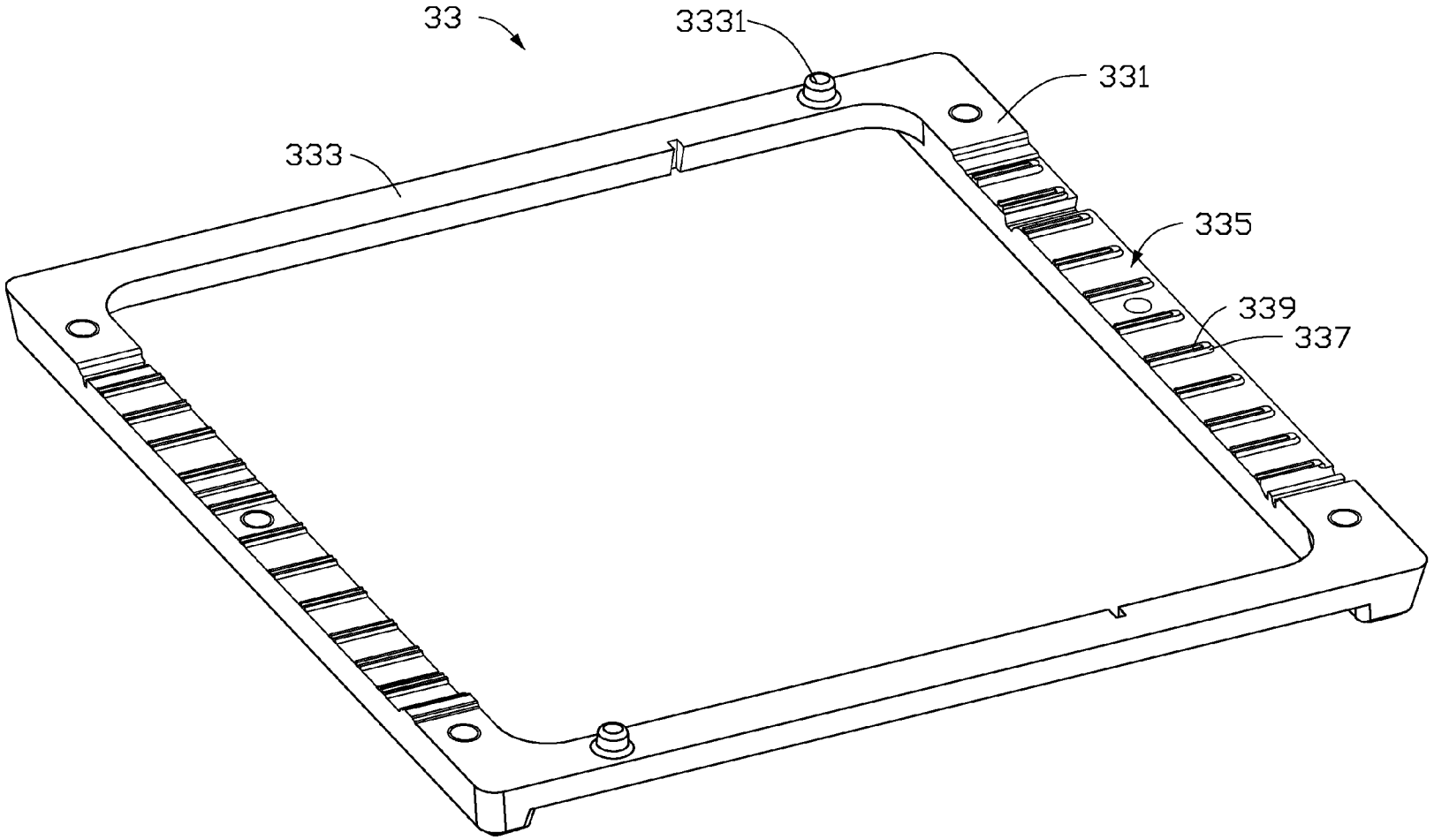
FIG. 8 is an enlarged, isometric view of the second position member of FIG. 2.

FIG. 8 illustrates that each first fixing portion 331 of the second position member 33 can define a groove 335. A plurality of second latching protrusions 337 can protrude from a bottom surface of the groove 335. The second latching protrusions 337 can correspond to the first latching protrusions 317. Each second latching protrusion 337 can define a latching groove 339 at a top thereof. A positioning post 3331 can protrude from each second fixing portion 333. Each positioning post 3331 can be aligned with one of the positioning holes 3131. The positioning posts 3331 can be coupled to the positioning holes 3131, such that the second position member 33 can be positioned on the first position member 31.

Figure 9:
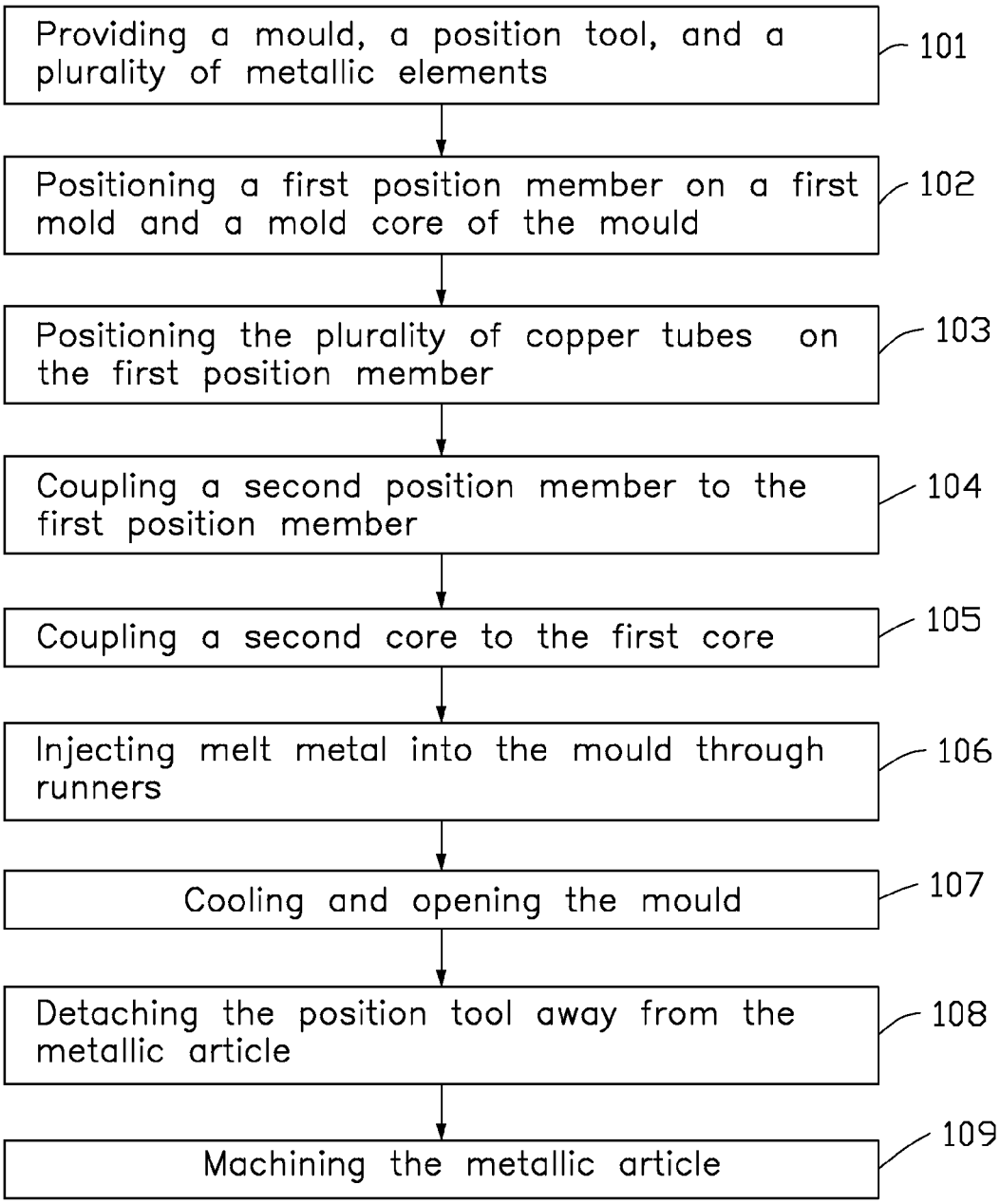
FIG. 9 is a flow chart of an embodiment of a method for manufacturing metallic article.

FIG. 9 illustrates a flowchart in accordance with an example embodiment. The example method is provided by way of example, as there are a variety of ways to carry out the method. The method described below can be carried out using the configurations illustrated in FIG. 1-8, for example, and various elements of the figure are referenced in explaining example method. Each block shown in FIG. 9 represents one or more processes, methods or subroutines, carried out in the example method. Additionally, the illustrated order of blocks is by example only and the order of the blocks can change. The example method can begin at block 101.

At block 101, a mould, a position tool, and a plurality of metallic elements made of a first material can be provided. The metallic element can be metallic sheet or metallic tube. Each metallic sheet or each metallic tube can include a first end and a second end opposite to the first end. In the illustrated embodiment, the one or more metallic elements are one or more copper tubes, and a number of the copper tube can be eleven. A diameter of each copper tube can be 0.3-0.5 mm.

At block 102, a first position member of a position tool can be positioned on a first mold and a mold core of the mould. Two first fixing portions of the first position member can be received in two third receiving grooves of the mold core, respectively. Two second fixing portions of the first position member can be received in two second receiving grooves of the first core.

At block 103, the eleven copper tubes can be positioned on the first position member. Each of the first end and the second end of each copper tube can be received in a latching groove of a first latching protrusion of the first fixing portion. A middle portion of each copper tube can be supported on second position protrusions of the mold core 25. In the illustrated embodiment, the eleven copper tubes can be parallel to each other.

At block 104, a second position member can be coupled to the first position member. Positioning posts 3331 of the second position member 33 can be inserted into the positioning holes of the first position member 31. Thus, the copper tubes can be positioned in the position tool.

At block 105, a second core can be coupled to the first core, thus the mould can be closed. The second core can be positioned above the first core. A pressing surface of the second core can contact the mounting surface of the first core. Two first fixing portions and two second fixing portions of the second position member can be received in a containing groove of the second mold. A plurality of first position protrusions of the second mold and the plurality of second position protrusions can clamp the copper tubes. Thus, the copper tubes can be firmly positioned between the second mole and the mold core. A gap between adjacent first position protrusions or a gap between adjacent second position protrusions can be in communication with the die cavity.

At block 106, melt metal made of a second material can be injected into the mould through runners. The second material has a heat conductivity lower than the first material. In the illustrated embodiment, melt aluminum can be injected into the mould. In at least one embodiment, other melt metal can be injected into the mould, such as melt magnesium.

At block 107, the mould can be cooled and opened. A metallic article formed by the mould and the position tool can be get out of the mould.

At block 108, the position tool can be detached away from the metallic article.

At block 109, the metallic article can be machined. In the illustrated, the metallic article can be deburred.

In at least one embodiment, the copper tubes can be positioned in the position tool first, and then the copper tubes and the position tool can be put into the mould together.

Figure 10:
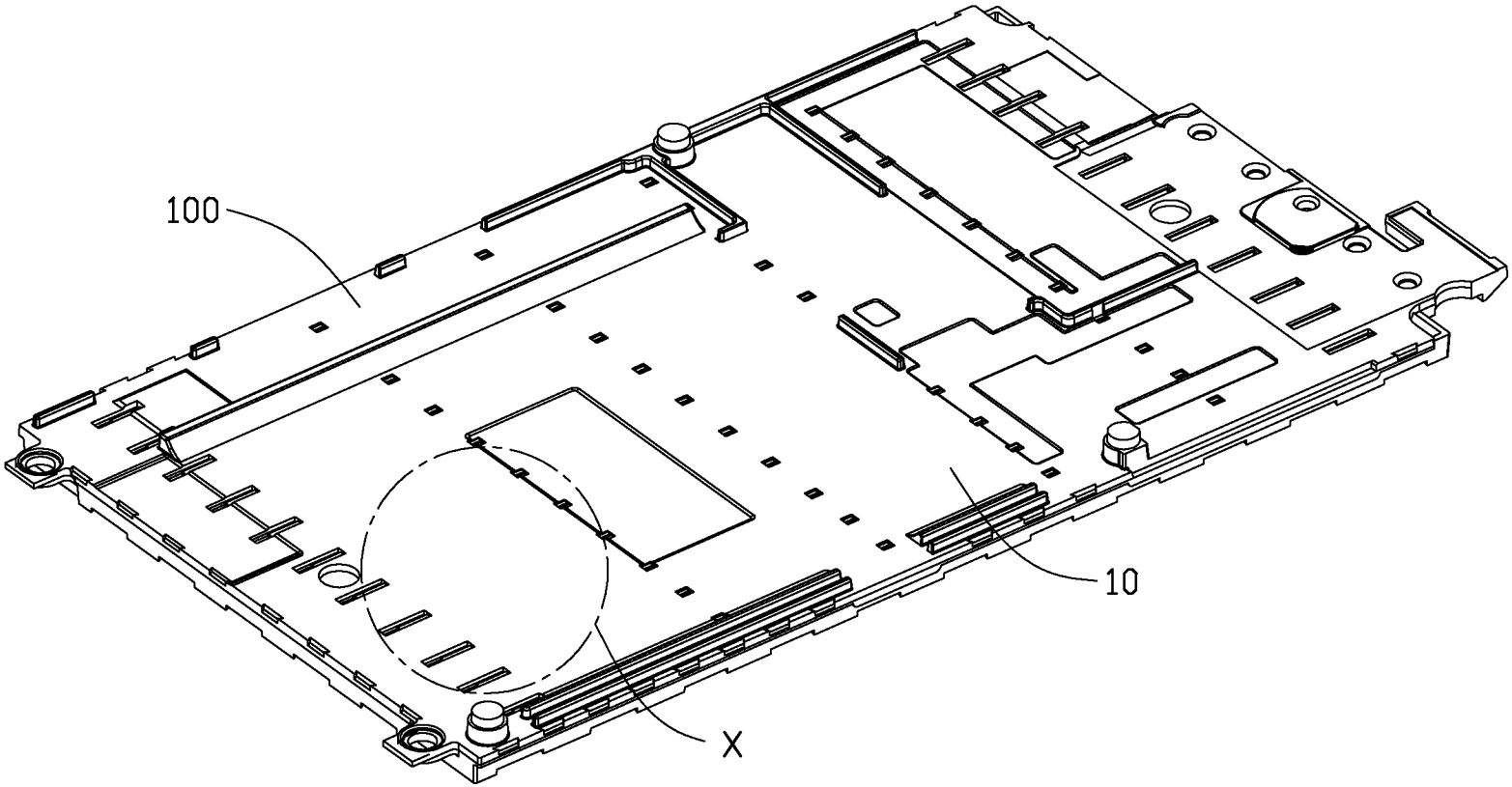
FIG. 10 is an isometric view of a first embodiment of a metallic article.
Figure 11:
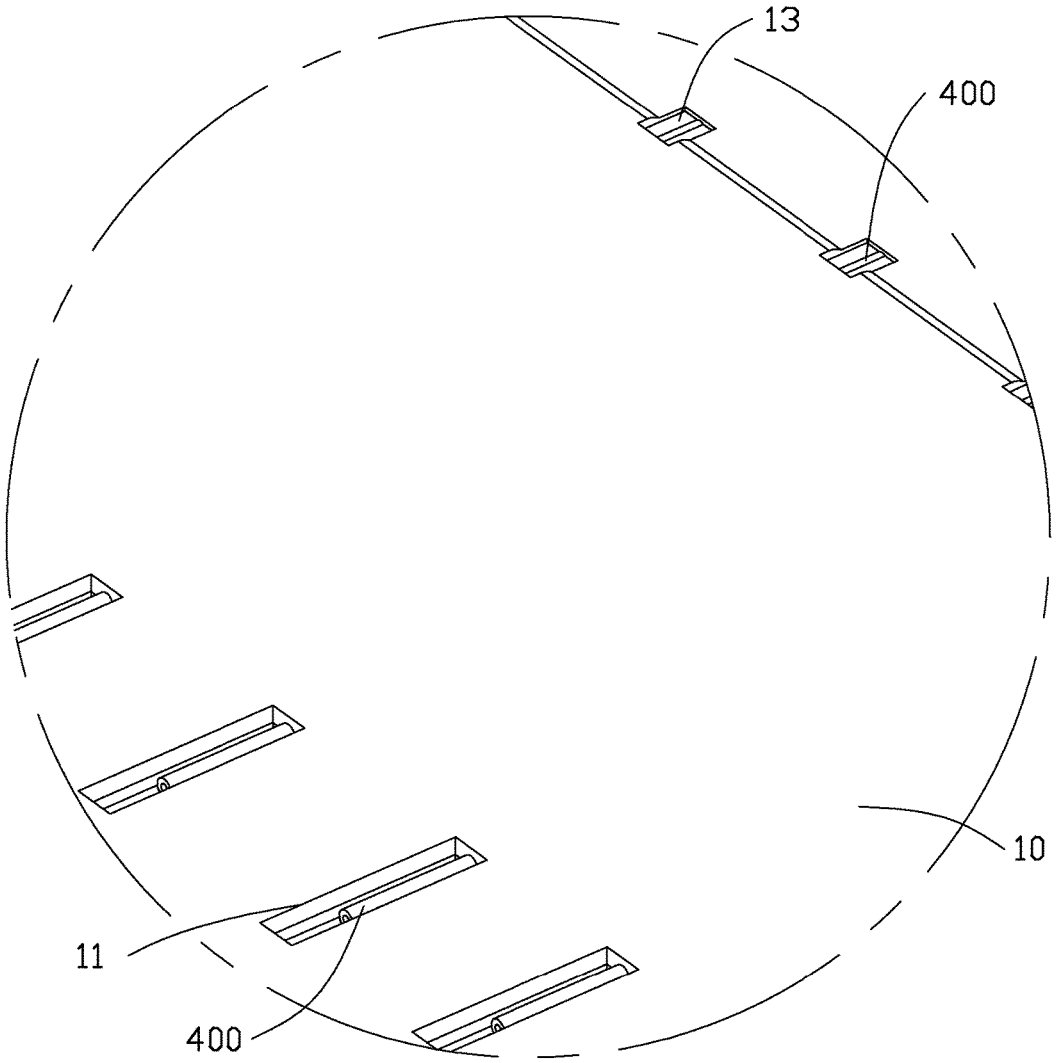
FIG. 11 is an enlarged view of a circle portion X of FIG. 10.

FIG. 10 illustrates an isometric view of a metallic article 100 manufactured by the mould 200 and the position tool 300. FIG. 11 illustrates the metallic article 100 can include a cast metallic body 10 and a plurality of metallic elements 400. The cast metallic body 10 can include a first surface and a second surface opposite to the first surface. The metallic element 400 can be made of a first material. The cast metallic body 10 can be made of a second material. The second material can has a heat conductivity lower than the first material. The metallic elements can be metallic sheets or metallic tubes. Each metallic sheet or each metallic tube can include a first end and a second end opposite to the first end. In the illustrated embodiment, the metallic elements 400 are copper tubes. The copper tubes 400 can be inserted in the cast metallic body 10. That is, the cast metallic body 10 can wrap the copper tubes 400 and be seamless with the copper tubes 400. As the copper tubes 400 can be clamped by the first position protrusions 236 and the second position protrusions 254, the metallic article 10 can define a plurality of first spaces 11 and a plurality of second spaces 13 at each of the first surface and the second surface. Each first spaces 11 can be in communication with the first end of the corresponding copper tube 400. Each second space 13 can be in communication with the second end of the corresponding copper tube 400. The first spaces 11 can correspond to the first latching protrusions 317 or the second latching protrusions 337. The second spaces 13 can correspond to the first position protrusions 236 or the second position protrusions 254. The first spaces 11 at each surface can be arranged two rows, and a number of first spaces 11 in each row can be eleven. The second spaces 13 at each surface can be arranged four rows and eleven columns. The second spaces 13 can be positioned between the two rows of the first spaces 11. Each first space 11 or each second space 13 can depress from the first surface or the second surface to the corresponding copper tube 400, such that the copper tubes 400 can expose from the first spaces 11 and the second spaces 13.

In at least one embodiment, a number of copper tubes 400 can be one or more than one, and copper tubes 400 can be inclined with each other. A number of each of the first latching protrusion 317, the second latching protrusion 337, the first position protrusion 236, the second position protrusion 254 can be changed corresponding to a number of the copper tubes 400. When the copper tubes 400 are short, the first position protrusions 236 and the second position protrusions 254 can be omitted. The copper tubes 400 can be instead of other members made of a first metallic material. The cast metallic body 10 can be made of a second metallic material which has lower heat conductivity than the first metallic material.

Figure 12:
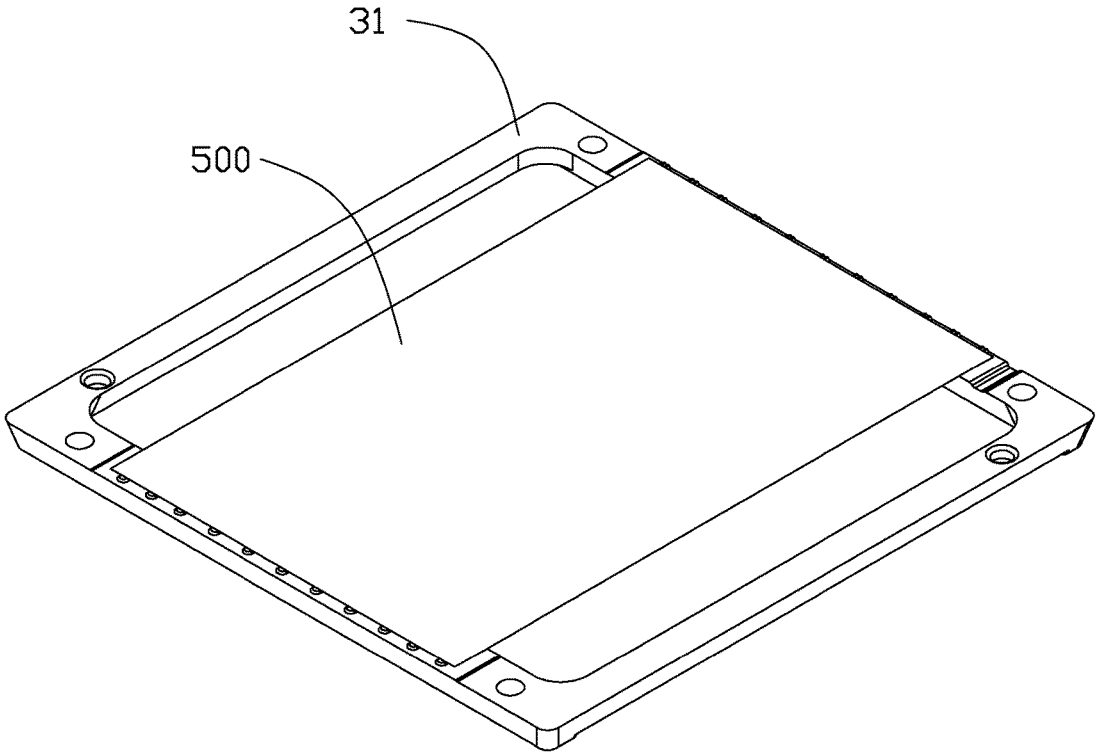
FIG. 12 is an assembled, isometric view of another embodiment of a first position member and a copper sheet.
Figure 13:
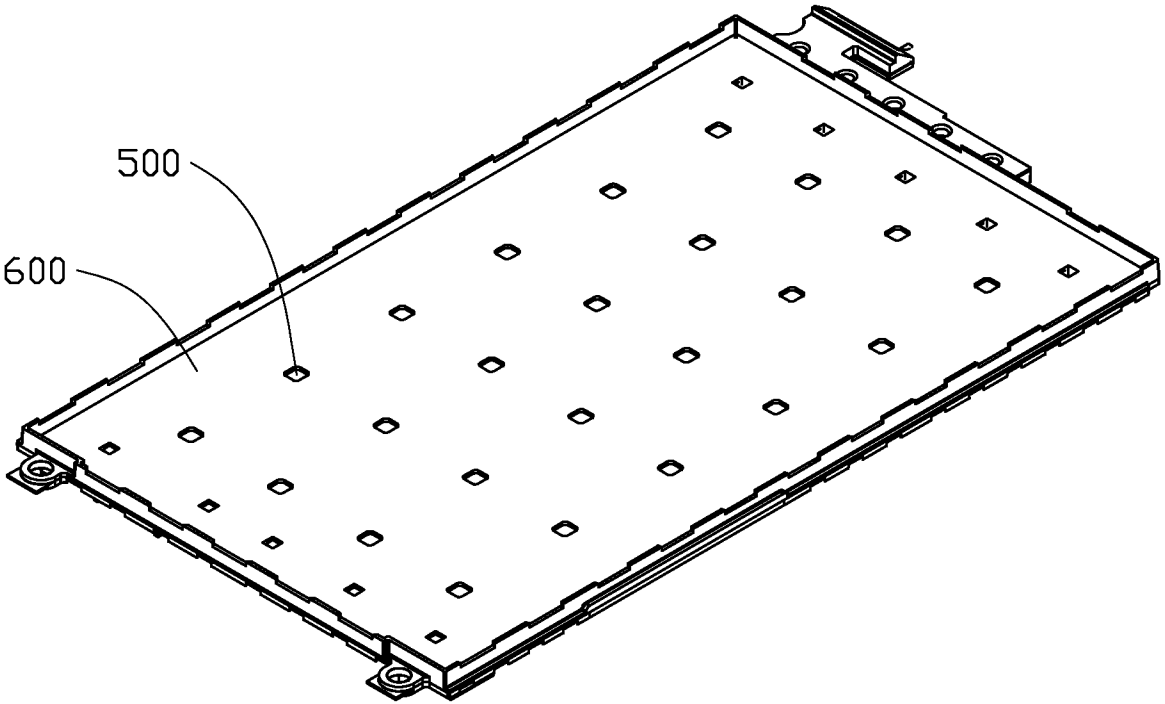
FIG. 13 is an isometric view of a second embodiment of a metallic article.

FIGS. 12 and 13 illustrate a metallic article 600 which includes a copper sheet 500 embedded therein. A manufacturing method for manufacturing the metallic article 600 can be similar to the first embodiment. During manufacturing the metallic article 600, the copper sheet 500 replaces the copper tubes 400 and the copper sheet 500 can be put on the first position member 31. In the illustrated embodiment, a thickness of the copper sheet 500 can be 0.2 mm.

The embodiments shown and described above are only examples. Many details are often found in the art such as the other features of a metallic article and a method of manufacturing metallic article. Therefore, many such details are neither shown nor described. Even though numerous characteristics and advantages of the present technology have been set forth in the foregoing description, together with details of the structure and function of the present disclosure, the disclosure is illustrative only, and changes may be made in the details, including in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. A method of manufacturing a metallic article comprising:

providing at least one metallic element;

providing a position tool for positioning the at least one metallic element, wherein the position tool comprises a first position member and a second position member detachably coupled to the first position member, the first position member and the second position member are both a substantially rectangular frame and both comprise two first fixing portions opposite to each other and two second fixing portions opposite to each other, each of the first fixing portions is coupled to the two second fixing portions, at least one first latching protrusion protrudes from each of the first fixing portions of the first position member, and at least one second latching protrusion protrudes from each of the first fixing portions of the second position member;

positioning the at least one metallic element on the at least one first latching protrusion of the first position member, and coupling the second position member with the first position member, such that the at least one first latching protrusion and the at least one second latching protrusion cooperatively position the at least one metallic element;

providing a mould having a die cavity and putting the position tool and the at least one metallic element into the die cavity of the mould, wherein the mould comprises a first mold, a mold core, and a second mold coupled onto the first mold, the first mold defines a first receiving groove and two second receiving grooves communicating with the first receiving groove, the second receiving grooves are positioned at opposite sides of the first receiving groove, the mold core is received in the first receiving groove and the second fixing portions of the first position member are respectively received in the second receiving grooves, and the die cavity is defined between the mold core and the second mold;

injecting melt metal into the mould, a heat conductivity of the melt metal being lower than a heat conductivity of the at least one metallic element;

cooling the mould, and taking the position tool and the metallic article out of the mould; and taking the metallic article out of the position tool.

2. The method of manufacturing the metallic article of claim 1, wherein at least one first position protrusion protrudes from the second mold, at least one second position protrusion protrudes from the mold core corresponding to the at least one first position protrusion, when the position tool and the at least one metallic element are received in the mould, the at least one first position protrusion and the at least one second position protrusion cooperatively position the at least one metallic element.

3. The method of manufacturing the metallic article of claim 2, wherein the two second fixing portions of the first fixing member are parallel to each other and the second receiving grooves are correspondingly parallel to each other.

4. The method of manufacturing the metallic article of claim 3, wherein the mold core defines two third receiving grooves parallel to each other, the at least one second position protrusions is positioned between the third receiving grooves, when the position tool is received in the mould, the first fixing portions of the first position member are respectively received in the third receiving grooves.

5. The method of manufacturing the metallic article of claim 1, wherein the at least one metallic element is at least one copper sheet.

6. The method of manufacturing the metallic article of claim 1, wherein the at least one metallic element is at least one copper tube.

7. The method of manufacturing the metallic article of claim 1, wherein each of the at least one first latching protrusion and the at least one second latching protrusion defines a latching groove.

8. A method of manufacturing a metallic article comprising:

providing at least one metallic element;

providing a position tool for position the at least one metallic element, wherein the position tool comprises a first position member and a second position member detachably coupled to the first position member, the first position member and the second position member are both a substantially rectangular frame and both comprise two first fixing portions opposite to each other and two second fixing portions opposite to each other, each of the first fixing portions is coupled to the two second fixing portions;

providing a mould, coupling the at least one metallic element to the first fixing portions of the first position member, and positioning the first position member into the mould, wherein the mould comprises a first mold, a mold core, and a second mold coupled onto the first mold, the first mold defines a first receiving groove and two second receiving grooves communicating with the first receiving groove, the second receiving grooves are positioned at opposite sides of the first receiving groove, the mold core is received in the first receiving groove and the second fixing portions of the first position member are respectively received in the second receiving grooves;

coupling the second position member with the first position member, such that the at least one metallic element is positioned between the first fixing portions of the first position member and the first fixing portions of the second position member;

injecting melt metal into the mould, a heat conductivity of the melt metal being lower than a heat conductivity of the at least one metallic element;

cooling the mould, and taking the position tool and the metallic article out of the mould, the at least one metallic element inserted in the metallic article; and taking the metallic article out of the position tool.

9. The method of manufacturing the metallic article of claim 8, wherein at least one first position protrusion protrudes from the second mold, at least one second position protrusion protrudes from the mold core corresponding to the at least one first position protrusion, when the position tool and the at least one metallic element are received in the mould, the at least one first position protrusion and the at least one second position protrusion cooperatively position the at least one metallic element.

10. The method of manufacturing the metallic article of claim 9, wherein the two second fixing portions of the first fixing member are parallel to each other and the second receiving grooves are correspondingly parallel to each other.

11. The method of manufacturing the metallic article of claim 10, wherein the mold core defines two third receiving grooves parallel to each other, the at least one second position protrusions is positioned between the third receiving grooves, when the position tool is received in the mould, the first fixing portions of the first position member are respectively received in the third receiving grooves.

12. The method of manufacturing the metallic article of claim 8, wherein the at least one metallic element is at least one copper sheet.

13. The method of manufacturing the metallic article of claim 8, wherein the at least one metallic element is at least one copper tube.

* * * * *